US005924915A

United States Patent [19]

Wachtler

[11] Patent Number: 5,924,915

[45] Date of Patent: Jul. 20, 1999

[54] HAND HELD SELF ALIGNING SHAFT GRINDER

[76] Inventor: William R. Wachtler, 515 Encinitas Blvd., Encinitas, Calif. 92023

[21] Appl. No.: 08/916,712

[22] Filed: Aug. 18, 1997

[51] Int. Cl.[6] ..... B24B 5/37

[52] U.S. Cl. ..... 451/178; 451/348; 451/241

[58] Field of Search ..... 451/424, 438, 451/439, 178, 348, 545, 241

[56] References Cited

U.S. PATENT DOCUMENTS

| | | | |
|---|---|---|---|
| 2,575,212 | 11/1951 | Foster | 451/348 |
| 3,085,476 | 4/1963 | Sloan et al. | 451/439 |
| 4,504,178 | 3/1985 | Seidenfaden | 451/241 |

FOREIGN PATENT DOCUMENTS

| | | | |
|---|---|---|---|
| 716791 | 2/1980 | U.S.S.R. | 451/439 |

*Primary Examiner*—Robert A. Rose
*Attorney, Agent, or Firm*—Frank D. Gilliam

[57] ABSTRACT

A hand-held centerless grinding apparatus for grinding and refinishing convex, concave and flat surfaces. When a surface has been grooved or otherwise indented, the damaged surface can be built up, then must be ground back to the original configuration. A box-like body structure having and open side has inwardly extending V-shaped openings in opposite end walls. A grinder having a drive motor and grinding wheel is mounted on a bracket for grinding wheel movement along a line bisecting the V-shaped opening. The box structure is arranged with the open side against the surface to be repaired. In the case of a shaft, the sides of the V-shaped opening engage the shaft. The bracket is adjusted to bring the grinding wheel to a position conforming to the intended surface configuration. The motor is turned on and the body is manually moved along the surface so that the grinding wheel grinds away any repair material extending above the desired surface. In another embodiment, the body is formed from a solid block of material by machining, casting, etc.

11 Claims, 3 Drawing Sheets

HAND HELD SELF ALIGNING SHAFT GRINDER

FIELD OF THE INVENTION

This invention relates to apparatus for refinishing small repaired areas on large shafts such as hydraulic pistons, cylinders or other surfaces that have been locally repaired by adding metal to a damaged area, such as by welding or electroplating.

BACKGROUND OF THE INVENTION

Often large shafts such as hydraulic pistons are damaged in relatively small areas, such as by impact, bearing seizure, etc. In the past, it has been necessary to remove such shafts and transport them to a machine shop for repair. The shaft would have grooved, indented or otherwise damaged surface corrected by adding metal to the damaged area by electroplating, adding weld metal, etc. Then the shaft would need to be mounted in a large stationary centerless grinder or lathe so that the damaged area could be reformed to the original shape. The shaft would then need to be returned to the vehicle repair shop for remounting.

Similar repair sequences are necessary where the interior of a large metal cylinder or a large flat metal surface is damaged. This repair sequence is expensive, time consuming and results in long vehicle or other apparatus down time.

A number of different devices have been developed for grinding metal objects, such as ice skate blades or the like without removing the part to be ground from the overall device. Typical of these are the chamfering or deburring tool described by Seidenfaden in U.S. Pat. No. 4,504,178 and skate sharpening devices such as described by Wurthman in U.S. Pat. No. 5,591,069. While effective for their intended purposes, these devices are not adaptable to grinding of repaired surfaces such as large shafts, internal cylinders, etc.

Shafts having bends that prevent them from being turned or ground in a conventional lathe or stationary grinder can be ground in a machine that can revolve around a part, rather than rotating the part itself, as described by Ekholm et al. in U.S. Pat. No. 2,086,492. However, this requires the movement of the entire grinding apparatus around a relatively thin shaft and is not useful in grinding large shafts and the like.

Thus, there is a continuing need for a portable, hand held, grinding assembly for grinding and finishing large shafts, the interior of large cylinders on site, that can be operated on-site and does not requiring transporting a part to be repaired to a central repair facility and that is adaptable to grinding of large shafts, large internal cylinders and large planar surfaces.

SUMMARY OF THE INVENTION

The above-noted problems, and others, are overcome in accordance with this invention by a hand held centerless grinding apparatus that basically comprises a body in the form of a box structure having a top and four attached walls or a machined solid block. Two opposite walls have complementary inwardly extending approximately V-shaped openings. While the walls of the V-shaped opening may have any suitable configuration, a parabolic curve is preferred as providing optimum accommodation of cylinders or internal tubular surfaces of widely varying diameters.

A grinder comprising an electrical drive motor with a grinding wheel mounted on the motor shaft is mounted on a plate. The plate extends across one of the sides having the V-shaped opening and is oriented so that the motor shaft lies along a line that bisects the opening "V".

Guide means at the ends of the plate extend around the body corners, so that the plate can be moved with the motor shaft moving along that line. A moving means, preferably a lead screw extending from the body top to a bearing that moves with the plate is provided for moving the plate and motor shaft along the V bisecting line.

When the grinding wheel edge is within the V-opening, the apparatus will ride along a large shaft with the wheel position adjusted to align with the proper shaft surface, so that any repair metal extending above that surface will be ground away, producing a smooth surface identical with the original shaft surface. When the grinding wheel edge is in the same plane as a flat surface, the grinding wheel will align with a flat surface and will grind away any repair metal extending above that surface. When the grinding wheel edge extends beyond the V-opening, the body can ride on the inner surface of a large cylindrical tube with the grinding wheel edge aligned with the tube surface so that any repair metal extending above that surface being ground away to provide a uniform cylindrical surface.

In an alternate embodiment, the device can be machined or cast from a solid block of material having a V-shaped channel for engagement with a cylindrical, tubular or flat workpiece. The block is hollowed out to receive the drive motor and includes a motor mounting bracket and lead screw moving arrangement of the sort described above.

BRIEF DESCRIPTION OF THE DRAWING

Details of the invention, and of preferred embodiments thereof, will be further understood upon reference to the drawing, wherein.

DETAILED DESCRIPTION OF PREFERRED EMBODIMENTS

Figure 1:
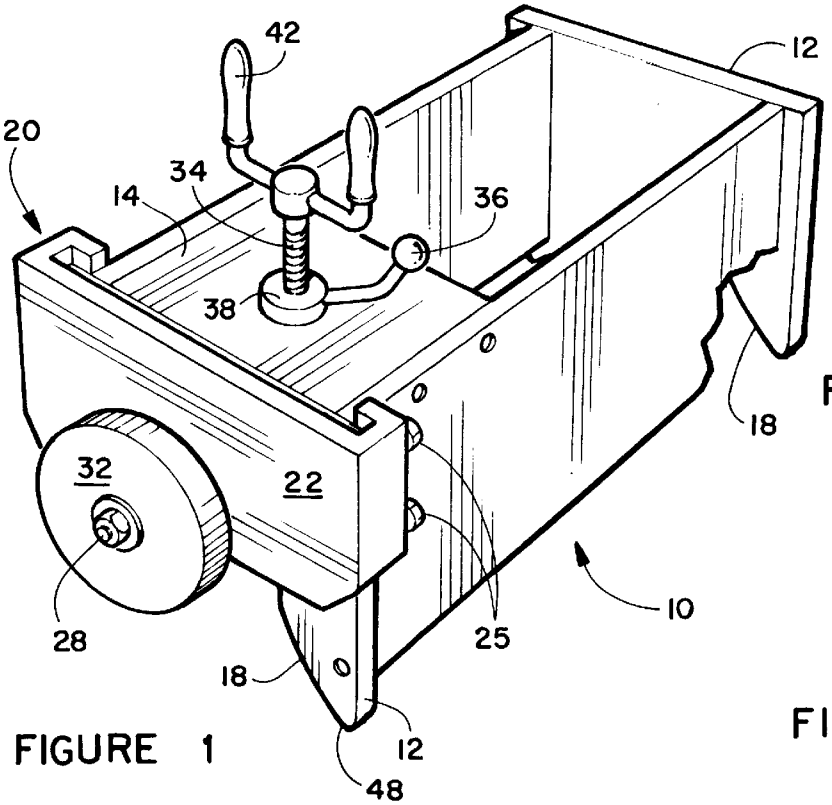
FIG. 1 is a perspective view of the hand held centerless grinding apparatus of this invention.

Referring to FIG. 1, there is seen a perspective view of the hand-held grinder of this invention. Basically, the apparatus has a body with a box-like structure 10 made up of two end walls 12, two side walls 14 and a top 16, with one open side opposite the top. End walls 12 have complementary generally V-shaped openings 18 extending inwardly from the open side of the body. The two surfaces that make up the V-shaped opening preferably have complementary curved surfaces, optimally a parabolic curve to give the greatest range of cylinders, etc. that can be accommodated. If desired, however, these surfaces could be straight. The two end walls and V-shaped openings are arranged so that the line between points of contact with a workpiece on the front and back walls are always parallel to the motor shaft. If desired, solid blocks could be used for the edges of the V-shaped openings, running from front to back of the assembly.

Body 10 may be formed from any suitable material, such as metal, wood, plastic, etc. In general a metal such as steel or aluminum is preferred for long term durability. The body will be sized to fit the repaired surface to be ground back to the original configuration. Typically the body may have a length of from about 4 to 10 inches and a width of from about 2 to 7 inches.

Where the sides are straight, the generally V-shaped opening may have any suitable angle between the sides of the "V". Preferably, that angle will be from about 70 to 120°.

Figure 2:
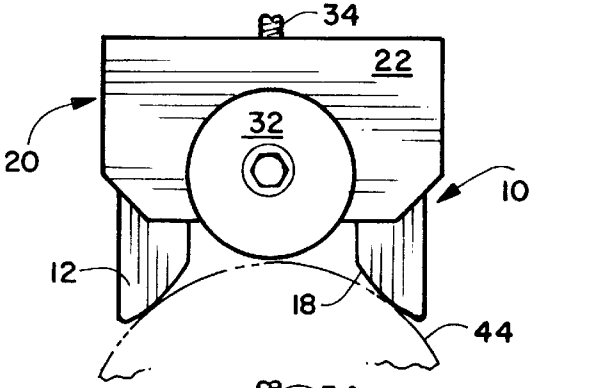
FIG. 2 is an end elevation view of the apparatus in contact with a cylinder.
Figure 3:
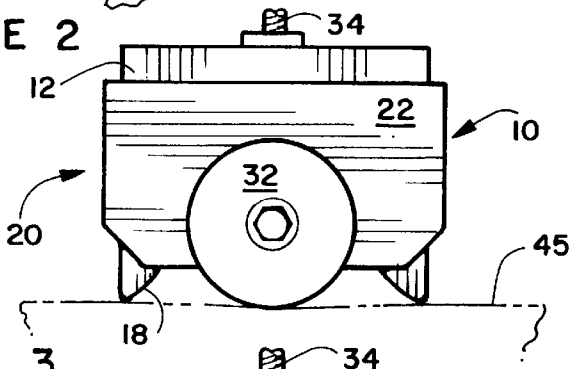
FIG. 3 is an end elevation view of the apparatus in contact with a flat surface.
Figure 4:
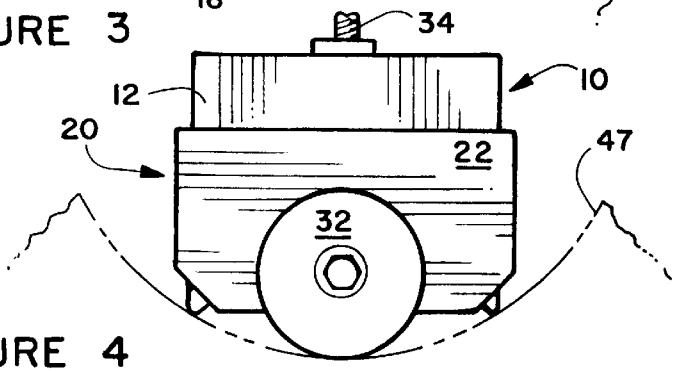
FIG. 4 is an end elevation view of the apparatus in contact with the internal surface of a large diameter tube.

The manner in which the edges of the V-shaped opening rest on a cylinder, flat surface and inner tube wall is illustrated in FIGS. 2–4, respectively. As can be seen, different lines along the curved edges rest on different surfaces, showing the broad range of workpiece surfaces with which the device may be used.

Figure 6:
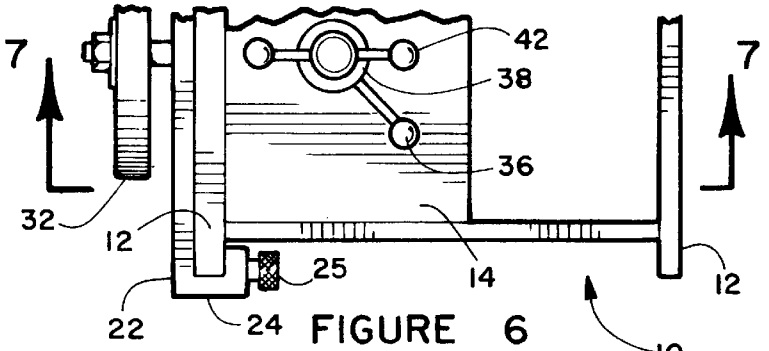
FIG. 6 is a partial plan view of the apparatus.

As best seen in FIGS. 1 and 6, a bracket 20 is positioned along the exterior of a first end wall 12 for sliding therealong. Bracket 20 has a generally broad U-shape with a central portion 22 in sliding engagement with first end wall 12 and two guide portions 24 that wrap around corners formed by end wall 12 and slightly extended side walls 14. Guide portions 24 keep bracket 20 parallel with top 16 as the bracket moves toward and away from V-shaped opening 18. Setscrews 25 are provided to lock bracket 20 at any desired position during grinding. If desired, tongue and groove guides may be used between bracket 20 and either the end or side wall, or slides similar to conventional drawer slides may be used to aid in assuring smooth relative movement.

Figure 7:
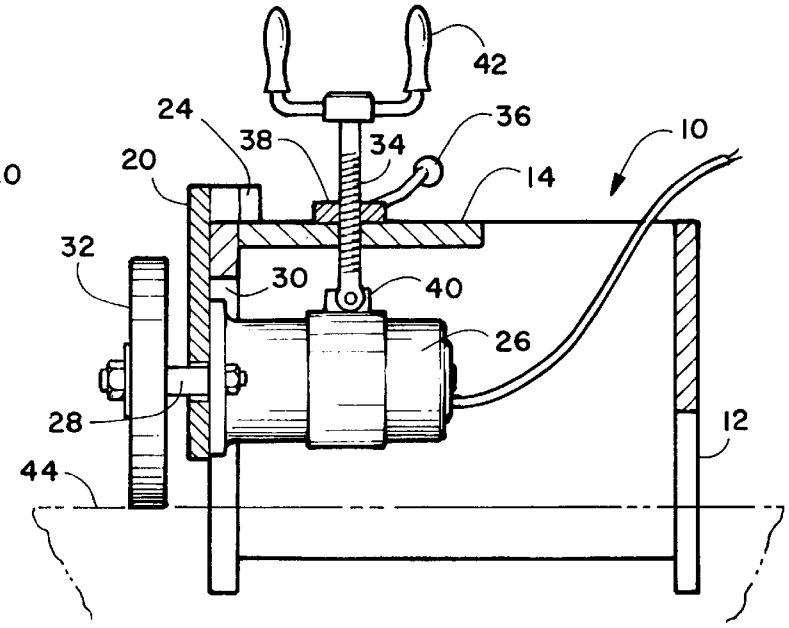
FIG. 7 is a section view taken on line 7—7 in FIG. 6.
Figure 5:
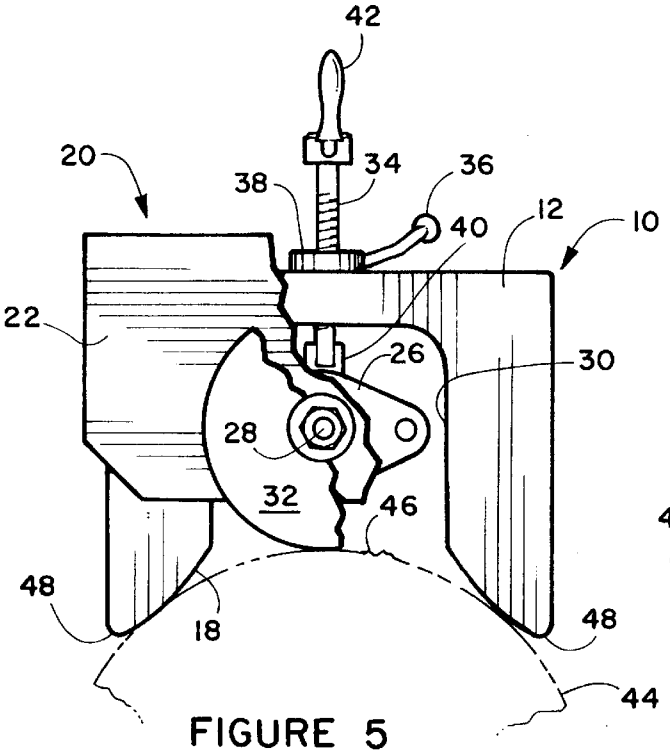
FIG. 5 is an end elevation view of the apparatus of FIG. 1 partially cut away to show internal structure.

As best seen in FIGS. 5 and 7, a drive motor 26 is secured to central portion 22 of bracket 20 by bolts or the like so that shaft 28 extends through the bracket. Any suitable motor may be used. In general, a conventional alternating current electrical motor is preferred, although an air motor or other drive, such as a flexible shaft drive, may be used, if desired. I have found that 900 rpm constant speed fan motors give excellent performance.

First end wall 12 includes a cutout central area 30 through which motor 26 extends, as seen in FIG. 5. A conventional grinding wheel 32 is mounted on shaft 28 for rotation in a manner overlapping V-shaped opening 18.

As best seen in FIGS. 1, 5 and 7, a lead screw 34 extends through a hole in top 16 above motor 26 and a lock nut 38, rotatable by handle 36 secured, such as by welding, to the top around the hole. The distal end 40 of lead screw 34 is captured in a bearing 40 secured to motor 26 so that the lead screw is freely rotatable relative to the motor but will move the motor up and down as the end of the lead screw moves up and down. Any other suitable moving means may be used, such as a rack and pinion arrangement, hydraulic cylinders, etc.

A handle 42 is secured to the proximal end of lead screw 34. As handle 42 is rotated in one direction, typically clockwise with a right-hand lead screw thread, the lead screw, motor 26 and bracket 20 move downwardly relative to V-shaped opening 18. Conversely, counter clockwise rotation of handle 42 will move motor 26 and bracket 20 upwardly. If desired, lead screw 34 or other moving means could be powered by an electric motor or the like and conventional electrical sensors could be used to position grinding wheel 32 the desired difference from the surface being repaired. Generally, however, the manual system shown is preferred for simplicity and reliability.

Where a large shaft has been repaired by adding metal through electroplating, welding, etc., to fill in grooves or other indentations, the added metal 46 will extend above the normal shaft surface. Also, if the shaft surface was grooved, such as by a failed bearing, often ridges of metal will have been pushed up adjacent to grooves.

Figure 8:
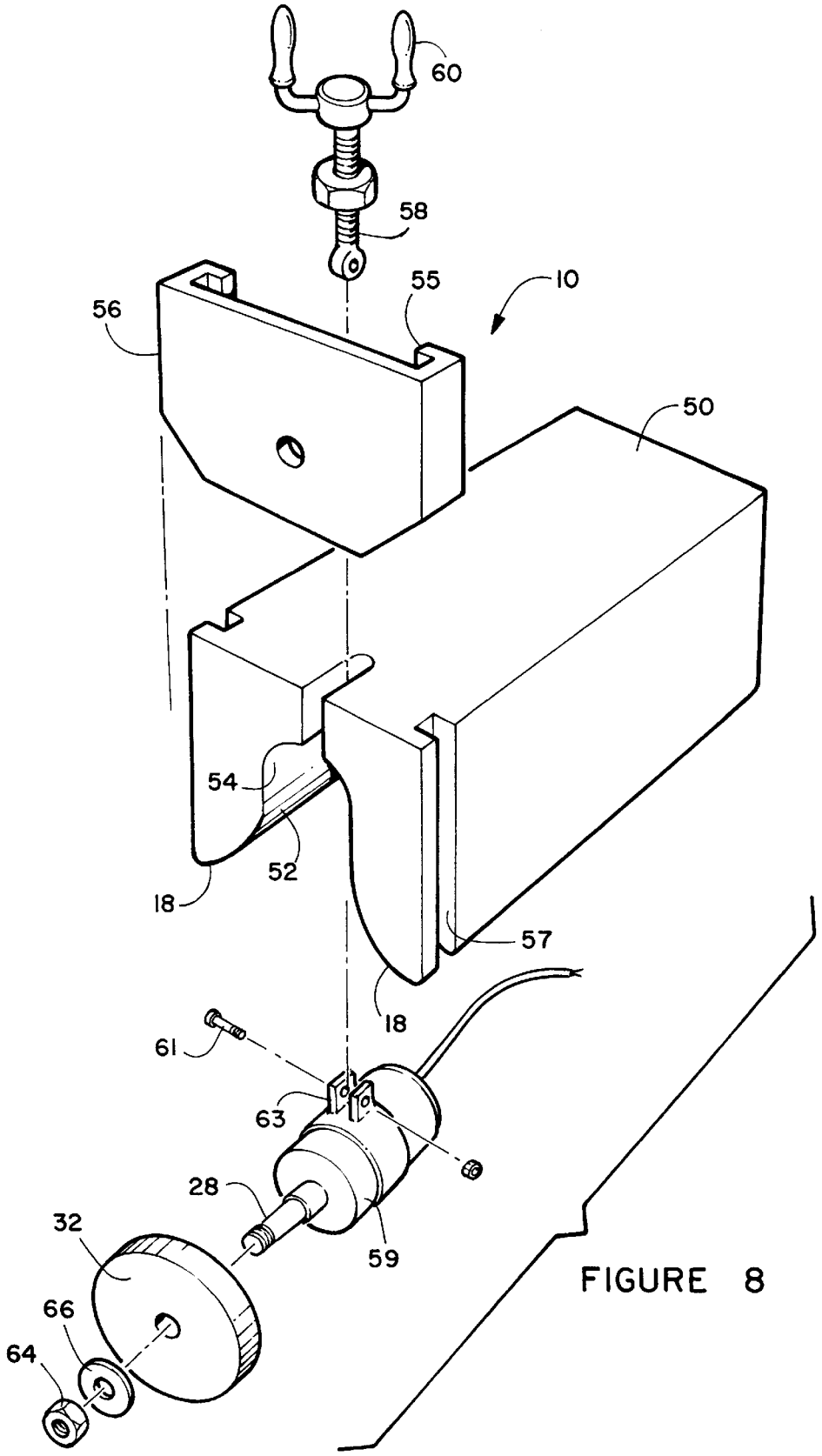
FIG. 8 is a perspective view of an alternate embodiment in which the body of the apparatus is formed from a solid block.

In an alternate embodiment of the apparatus 10, as seen in FIG. 8, the apparatus body may be formed from a single block 50 of material by casting, machining or the like, rather than assembled from separate side and end walls. A V-shaped channel 52 is formed in the bottom side of block 50 to a configuration of the sort shown for end walls 12, as described above. in this case, a workpiece will contact the entire length of the channel, with the lines of contact substantially parallel with motor shaft 28. The interior of block 50 has a central hollow or bore 54 to receive motor 26, with room to allow movement of the motor with bracket 56, which is similar to bracket 20 described above and has edges 55 that ride in grooves 517. A lead screw 58 (extending through a hole drilled in block 50) and handle 60 operate in the same manner as lead screw 34 and handle 42 as described above. Motor 59 is mounted on lead screw by bolt 61 and bracket 63.

In order to return the repaired shaft surface areas to the normal surface and shaft diameter, body 10 is placed over a shaft with V-shaped surfaces 18 in contact with the shaft surface. Wheel 32, held on shaft 28 by nut 64 and washer 66 is adjacent to an area along shaft 44 that has not been damaged or repaired and has the normal surface configuration, handle 42 is turned to lower wheel 32 to very near contact with the shaft. Then motor 26 can be turned on to begin rotation of grinding wheel 32 and the body is moved along shaft 44 while carefully keeping V-shaped openings 16 in contact with the shaft. All higher than normal areas on shaft 44 will automatically be ground down to the original shaft size. The location of wheel 32 relative to the shaft surface can be precisely adjusted as needed during the refinishing operation to accommodate grinding wheel wear, etc. The shaft can be rotated and the body moved along and around the shaft surface until all high areas have been removed and the shaft has the desired concentricity. While generally simply sliding the body along is very effective, the engaging edges could be lubricated or small rollers could be used to aid in tracking along the shaft.

This apparatus can also repair and refinish flat surfaces, as seen in FIG. 3 and the internal wall of large tubular structures as seen in FIG. 4. With a flat surface, the corners 48 of opening 18 will ride along the surface. Grinding wheel 32 will be lowered to have the desired relationship with the flat surface. When operating, the grinding wheel will automatically grind away any high spots.

Similarly, with large tubular workpieces, body 10 will be placed against the concave surface with side corners 48 (or rollers 49) engaging the surface. Grinding wheel 32 will be lowered until it extends beyond the plane of sidewall corners 48 and is in operative relationship to the tube concave surface. Motor 26 is turned on and body 10 is moved around the surface, automatically grinding away any high areas.

While certain specific relationships, materials and other parameters have been detailed in the above description of preferred embodiments, those can be varied, where suitable, with similar results. Other applications, variations and ramifications of the present invention will occur to those skilled in the art upon reading the present disclosure. Those are intended to be included within the scope of this invention as defined in the appended claims.

I claim:

1. A hand held self aligning shaft grinder, which comprises:

a first support member having first and second intersecting surfaces forming an acute angle and an apex line;

said support member having an end surface substantially perpendicular to said apex line;

a second support member having third and forth intersecting surfaces forming an acute angle, said third and forth surfaces being substantially parallel to said first and second surfaces;

said first and third and said second and forth surfaces configured as complementary parabolic curves;

mounting means for supporting a grinding wheel on a shaft with a plane of rotation substantially parallel to said end surface;

moving means for moving said grinding wheel across said end surface along a line passing through said apex and between sides of said angle; and;

drive means for rotating said grinding wheel.

2. The hand held self aligning shaft grinder according to claim 1 wherein contact lines between said first and second surfaces and an object having a shape selected from the group consisting of cylinders, flats and tube interiors are substantially parallel to said shaft.

3. The hand held self aligning shaft grinder according to claim 1 wherein said mounting means comprises a bracket for carrying said grinding wheel and drive means and further including guide means for guiding said bracket along said line.

4. The hand held self aligning shaft grinder according to claim 1 wherein said line substantially bisects said acute angle.

5. Hand-held centerless grinding apparatus for refinishing surfaces, which comprises:

a body structure having a rectangular top, two end walls and two sidewalls secured together to form a unitary box structure having an open side;

each end wall having a generally V-shaped openings extending inwardly from said open side;

a grinder comprising a drive motor and a rotatable grinding wheel;

a bracket for mounting said grinder for movement of said grinding wheel over said first wall, approximately along a line bisecting said V-shaped openings; and moving means for moving said grinder along said line.

6. The apparatus according to claim 5 wherein said bracket comprises a generally U-shaped plate having a base extending across said first wall and legs extending around corners formed by said first wall and walls secured thereto.

7. The apparatus according to claim 6 wherein said moving means comprises a lead screw operatively connected to said bracket, oriented substantially parallel to said line and extending out of said body to a manually rotatable handle.

8. The hand held self aligning shaft grinder according to claim 5 wherein contact lines between said first and second surfaces and an object having a shape selected from the group consisting of cylinders, flats and tube interiors are substantially parallel to said shaft.

9. Hand-held centerless grinding apparatus for refinishing surfaces, which comprises:

a solid block structure having a rectangular top, a bottom, first and second end surfaces and two side surfaces;

a generally V-shaped channel extending inwardly from said bottom;

a grinder comprising a drive motor and a rotatable grinding wheel;

an opening in said solid block structure for receiving said grinder and permitting movement of said grinder toward and away from said V-shaped channel;

a bracket over said first end surface for mounting said grinder for movement of said grinding wheel, approximately along a line bisecting said V-shaped channel; and moving means for moving said grinder along said line.

10. The hand held self aligning shaft grinder according to claim 9 wherein contact lines between said first and second surfaces and an object having a shape selected from the group consisting of cylinders, flats and tube interiors are substantially parallel to said shaft.

11. The apparatus according to claim 9 wherein said moving means comprises a lead screw operatively connected to said bracket, oriented substantially parallel to said line and extending out of said block through a hole to a manually rotatable handle.

* * * * *